US005829336A

United States Patent [19]

Schulze

[11] Patent Number: 5,829,336

[45] Date of Patent: Nov. 3, 1998

[54] HYDRAULIC DRIVE UNIT

[75] Inventor: Eckehart Schulze, Weissach, Germany

[73] Assignee: Hartmann & Lammle GmbH & Co., KG, Rutesheim, Germany

[21] Appl. No.: 646,229

[22] PCT Filed: Mar. 9, 1995

[86] PCT No.: PCT/EP95/00884

§ 371 Date: May 9, 1996

§ 102(e) Date: May 9, 1996

[87] PCT Pub. No.: WO95/24565

PCT Pub. Date: Sep. 14, 1995

[30] Foreign Application Priority Data

Mar. 9, 1994 [DE] Germany ..... 44 07 765.3

[51] Int. Cl.[6] ..... F15B 9/10

[52] U.S. Cl. ..... 91/365; 91/380; 91/368

[58] Field of Search ..... 91/365, 368, 380

[56] References Cited

U.S. PATENT DOCUMENTS 4,161,905 7/1979 Ota ..... 91/363 R 4,901,627 2/1990 Schulze ..... 91/374

FOREIGN PATENT DOCUMENTS 3614577 12/1986 Germany .

*Primary Examiner*—F. Daniel Lopez

*Attorney, Agent, or Firm*—Antonelli, Terry, Stout, & Kraus, LLP

[57] ABSTRACT

A hydraulic drive unit has a tracking regulator valve (19) for controlling a servo drive (18) of a main control valve (16), where the main control valve controls flow to a hydraulic motor (11). The tracking regulator valve is controlled by an actuating element (42), which is controlled by a comparison of a nominal position value, set by an electric motor (36), and an actual position valve, generated by a mechanical feedback (53) connected to the hydraulic motor. The main control valve includes a slide valve piston (87), which forms a housing for the tracking regulator valve, which has two piston slide valve elements (39, 41). The slide valve piston (87) of the main control valve (16) has an axial through-bore (122) through which passes the actuating element. The servo drive (18) is a dual-action hydraulic cylinder, which includes drive pressure chambers (33, 34) formed by axial blind bores (118, 118') in the valve piston (87) of the main control valve (16) and pistons (138, 138') accommodated in the blind bores.

17 Claims, 4 Drawing Sheets

HYDRAULIC DRIVE UNIT

The invention relates to a hydraulic drive unit with a hydraulic motor as a power drive, said motor being designed for a high drive power and accordingly (necessarily) high throughput of hydraulic oil, a main control valve by means of which an afflux of hydraulic oil under high pressure to the power drive, as well as the efflux of at least a portion of the hydraulic oil supplied to the power drive, for example to the zero-pressure supply container of the pressure supply assembly, can be controlled, a hydraulic servo drive designed as a double-acting linear cylinder for actuating the main control valve, and with an overtravel regulating valve, provided to control the servo drive, with setting of the setpoint of the position as well as the speed of movement of the movable element of the power hydraulic motor under electric motor control and mechanical feedback of the corresponding actual values, said valve assuming a blocking position corresponding to the stoppage of the power drive when the setpoint and actual value of the controlled position are the same, said blocking position being controllable by the position setpoint setting to assume the alternate through flow positions assigned to the alternate drive directions of the power hydraulic motor, in which positions the respective effective through flow cross section varies monotonically with the degree of deflection of the valve and is controllable by the position actual value feedback upon assumption of the blocking position, with the overtravel regulating valve and the main control valve being designed as piston slide valves operable by relative axial displacements of their valve pistons and housing elements that occur along axes that are parallel to one another, and the piston of the main control valve forms the housing of the overtravel regulating valve. In a known hydraulic drive unit of this type (U.S. Pat.) the overtravel regulating valve has a piston that is elongate and in the form of a rod, and is displaceable in a central axial through bore of the piston of the main control valve in a pressure-tight manner, said rod-shaped piston, viewed in the axial direction, traversing drive pressure chambers located on both sides of the main control valve piston, by whose alternate exposure to pressure and release, controllable by means of the overtravel regulating valve, produces the servo drive of the main control valve piston, with the piston of the overtravel regulating valve also having to be guided displaceably in a pressure-tight manner in the end walls forming the housing-integral axial limits of these two drive pressure chambers of the housing of the main control valve. One end of the piston of the overtravel regulating valve projects out of the housing of the main control valve and is firmly connected at this end with a rack meshing with a pinion of the electromechanical position setpoint setting and actual value feedback, said pinion being drivable by a differential gearbox that produces the phase comparison required for overtravel regulation.

The known drive unit, because of the design described above, suffers from at least the following disadvantages:

The manufacture of the assembly formed by the main control valve and the overtravel regulating valve is extremely expensive in view of the precision required for reliable function, since the bores of the housing of the main control valve that receive the respective end sections of the piston of the overtravel regulating valve and the central bore of its valve piston, with the required exactly flush arrangement, are very difficult to produce, and the exact arrangement of the controlling edges of the piston of the overtravel regulating valve with respect to the control edges of the piston of the main control valve, to the extent that the latter are supposed to have a zero overlap that is as exact as possible in the blocking position of the overtravel regulating valve, is also very expensive, with the result that the known drive unit suffers from high manufacturing costs.

It is also disadvantageous that the large-area limits of the driving pressure chambers of the servo drive for the pistons of the main control valve, each of which is formed by one of the annular ends of the piston itself, necessarily lead to large quantities of the controlling oil streams, which is disadvantageous especially in the case of a hydrodynamic drive of a servo motor, since a great deal of energy is required for the servo circuit at that time.

Hence, the goal of the invention is to improve a drive unit of the species recited at the outset in such fashion that a precise configuration of the controlling edges of the overtravel regulating valve on the valve piston side and on the housing side is feasible at considerably reduced expense and the requirement for hydraulic controlling energy is considerably reduced.

The overtravel regulating valve has two piston elements received by a through bore of the main control valve piston that is parallel to the central lengthwise axis of the main control valve piston, with this bore being located at a radial distance from the central lengthwise axis of the main control valve; the axial spacing of these piston elements, in order to adjust a specific overlap of the controlling edges on the piston side and the controlling edges of the overtravel regulating valve on the housing side, is located inside the through bores of the piston of the main control valve, especially for setting the zero overlap of such control edges that is suitable for a sensitive regulating operation. As a result, by simple means, the manufacturing tolerances of the piston elements can be matched perfectly by adjusting them, and a manufacturing technique is possible that largely eliminates costly waste and high manufacturing cost.

In addition, the piston of the main control valve is provided with a central axial through bore through which passes a set value setting element nonrotatably coupled with the drive shaft of the set value setting motor but axially displaceable relative to the latter and the piston. This set value setting element is in zero-play threaded engagement, in the manner of a spindle-nut drive, with an actual value feedback element drivable rotationally by the movable part of the power hydraulic motor in a positive correlation with its rotational or translational movements, with the same direction of rotation as the set value setting element, but mounted axially nondisplaceably on the housing of the main control valve, in the manner of a spindle-nut drive in zero-play threaded engagement. As a result, the setpoint setting element undergoes axial deflections relative to a central position of the piston elements linked with the blocking position of the overtravel regulating valve, with said deflections having a direct correlation with the difference between the set and actual positions of the movable part of the power hydraulic motor; these deflections intervene by means of actuating elements that are decoupled rotationally with respect to the setpoint setting element, but the axial movements of said elements follow the opening and closing actuations of the overtravel regulating valve.

In this design, centering of structural elements that are displaceable relative to one another is only necessary with respect to a part that can be manufactured in one piece, thus eliminating the considerable manufacturing expense that would otherwise be required. This also applies with respect to the servo drive provided for actuating the main control valve, the driving pressure chambers of said drive being delimited by blind holes in the main control valve piston located at a radial distance from the central axial through bore of the piston and parallel thereto and by the piston received by the latter and supported axially in the housing of the main control valve, said pistons not being aligned exactly flush with one another nor permanently connected with the housing, but only having to be firmly supportable axially on the latter. The drive cylinders provided in this manner inside the wall thickness of the main control valve piston, which together with their axially supported pistons each form a single-acting hydraulic cylinder and as a cylinder pair produce a double-acting hydraulic cylinder, are controllable by relatively small control oil volumes to perform the required deflection strokes of the main control valve piston and, utilizing the operating pressure of the supply source, can easily deliver the positioning forces required for high dynamic operation of the main control valve.

The hydraulic drive unit according to the invention is suitable both for volumetrically controlled rotational hydraulic motors, such as axial piston motors for example, and also for precise control of hydraulic linear motors, independently of the speed at which said motors are operated, and is therefore very well suited as a positioning drive.

The properties of the drive unit according to the invention in this regard can be significantly improved by a fine control valve having two piston elements displaceably mounted in a pressure-tight fashion in an axial through bore of the valve piston of the main control valve, said elements being located in an axial through bore of the valve piston of the main control valve, being readily integratable into the latter, with the adjustability of its axial distance in a preferred design, required for setting of a certain slight positive overlap desired in basic position 0 of the fine control valve.

The fine control valve is formed by means of the two piston elements in an exploded design, so to speak, as two jointly operable 2/3-way valves provided in the piston of the main control valve, preferably in the arrangement diametrally opposite the overtravel regulating valve.

The design includes a positioning cylinder intended for actuating both the main control valve and the fine control valve, by means of which the latter is in turn integratable into the piston of the main control valve.

If the piston of the main control valve is provided with two blind holes made in the opposite end faces of the main control valve piston, in which, for delimitation, one piston is provided displaceably and in a pressure-tight manner in each of its drive chambers relative to its bottom side, said piston being supportable axially on a stop pin permanently mounted on the housing of the main control valve and possibly adjustable axially, these pistons can be placed in these bores as free pistons, in other words without a return element.

If the necessary positioning forces for actuating the main control valve cannot be produced with a positioning cylinder comprising only a single pair of bores and pistons, the positioning cylinder can also be made with two pairs of bores and pistons, with it also being advantageous to arrange the latter in such fashion that the positioning force moments are equalized, which in general can be achieved by an axially symmetric grouping of the pairs of bores and pistons around the central lengthwise axis of the main control valve piston.

The design of the positioning cylinder or of a positioning cylinder system possibly comprising a plurality of bore and piston pairs as a differential cylinder unit or combination, has the advantage that the overtravel regulating valve provided for their control can be a simply constructed 3/3-way valve which can be provided in the so-called exploded design by two simultaneously operable 2/3-way valves.

The design of the differential cylinder with a 2:1 area ratio of its larger and smaller effective piston areas produces the same actuating force in both actuating directions.

The design of the piston of the main control valve is especially advantageous from the manufacturing standpoint when the overtravel regulating valve, the fine control valve, and also the positioning cylinder are largely integrated into the main control valve piston, and elements of the feedback device and the setpoint setting device are possibly received by a central bore in the central piston part, whereby short lengths of the oil columns that determine the hydraulic rigidity of the drive unit and high regulating circuit amplification values can also be achieved.

Position sensors can be used for adjusting the main control valve and the fine control valve as well as the overtravel regulating valve and, during operation of the drive unit, can also be used for monitoring the overtravel distance of the positioning elements, i.e. for a continuous determination of the circuit amplification of the regulating circuit.

Further details of the drive unit according to the invention will be apparent from the following description of an embodiment with reference to the drawing.

FIG. 1 is a hydraulic equivalent circuit diagram of a drive unit according to the invention, with a linear double-acting hydraulic cylinder designed as a differential cylinder as the power drive, a main control valve, and a fine control valve, which are operable by means of a positioning drive likewise designed as a double-acting differential cylinder and with an overtravel regulating valve acting with the setpoint setting being controlled by an electric motor and a mechanical actual value feedback of the position of the drive piston of the power drive;

Figure 1:
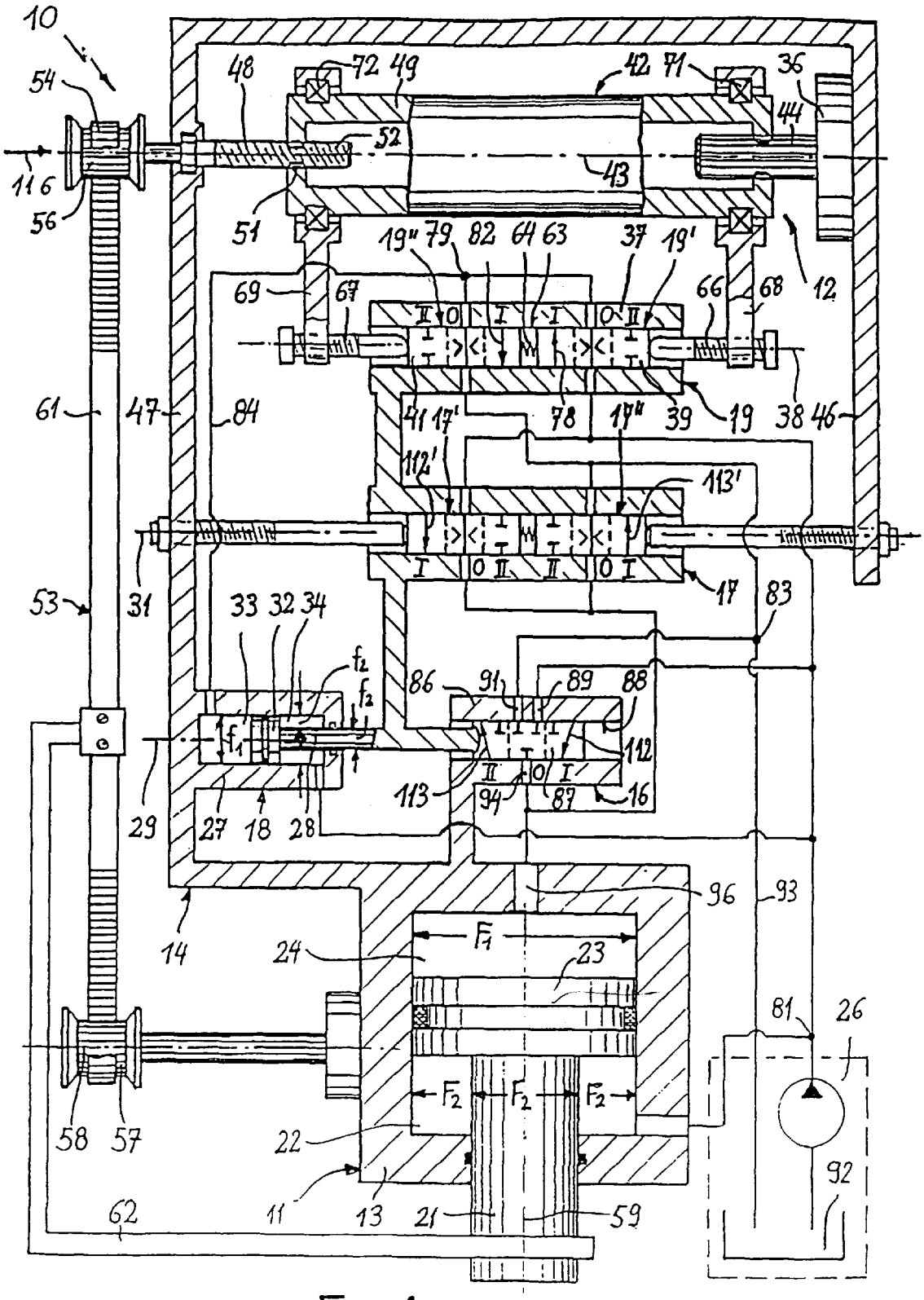
Figure 2:
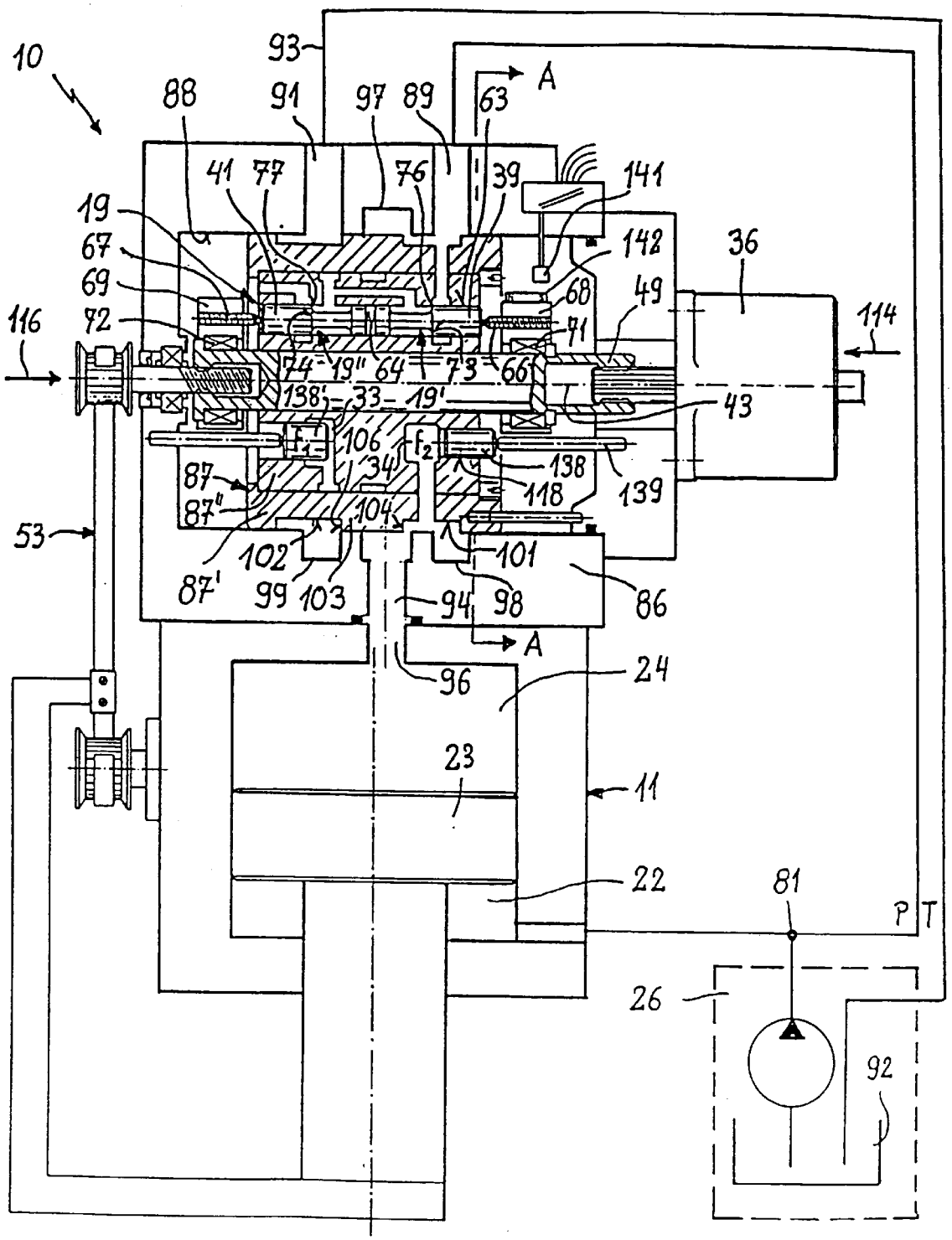
FIG. 2 is a lengthwise section through the main control valve and the overtravel regulating valve integrated therein, as well as through the positioning cylinder, in two mutually perpendicular planes along line B—B in FIG. 4, as well as the power drive in a sectioning plane that contains its central lengthwise axis as well as the central lengthwise axis of the main control valve.
Figure 3:
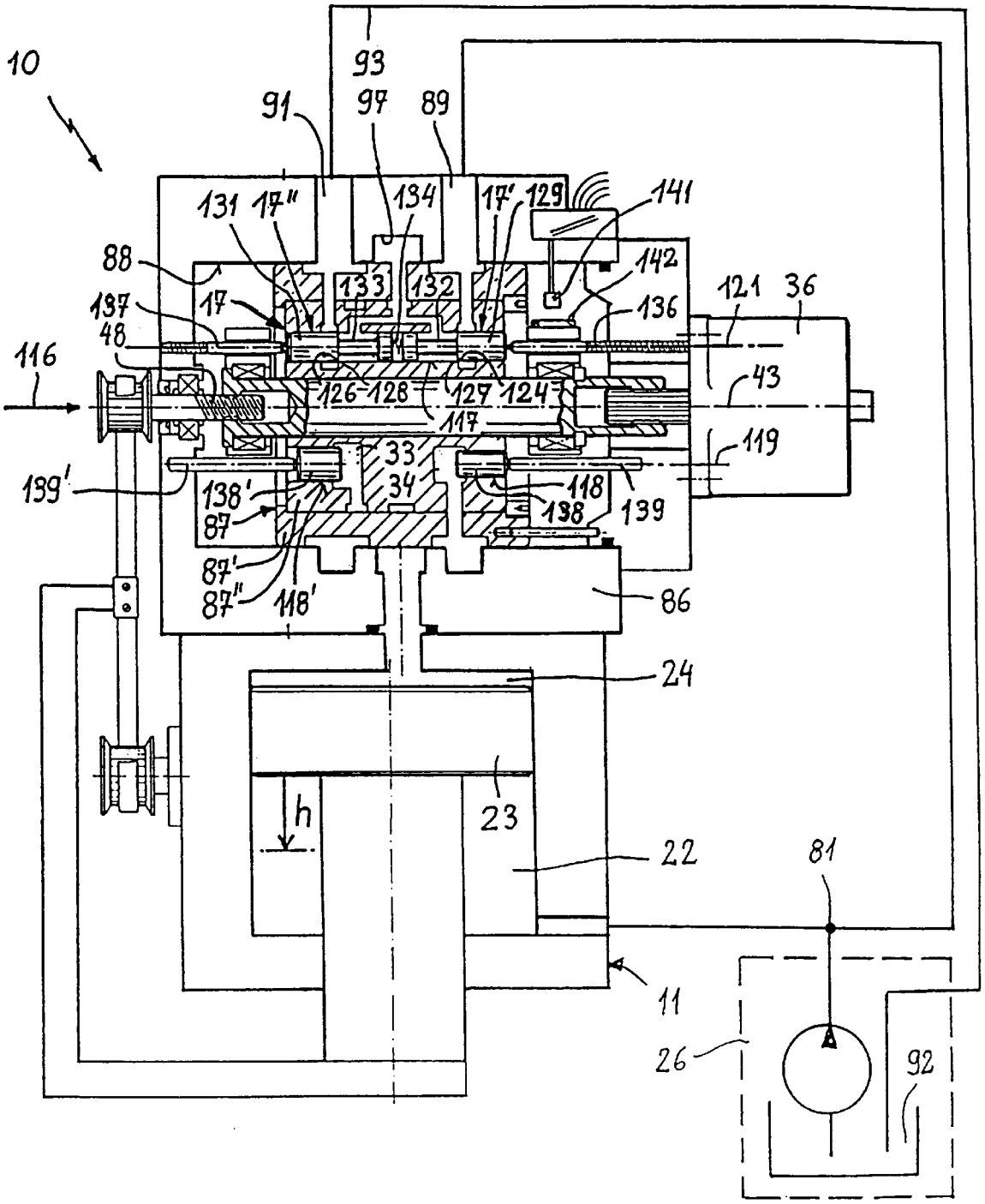
FIG. 3 is a lengthwise sectional representation similar to the drawing in FIG. 2 that contains the central lengthwise axis of the fine control valve, along line C—C in FIG. 4.
Figure 4:
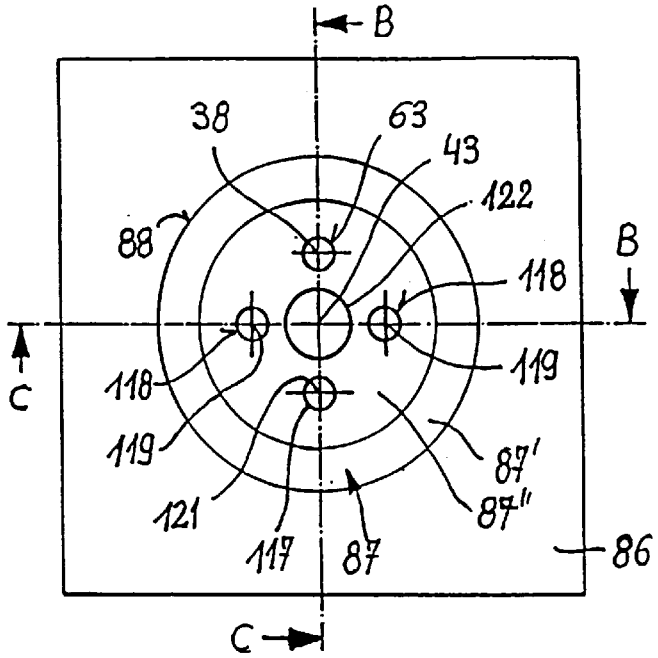
Figure 5A:
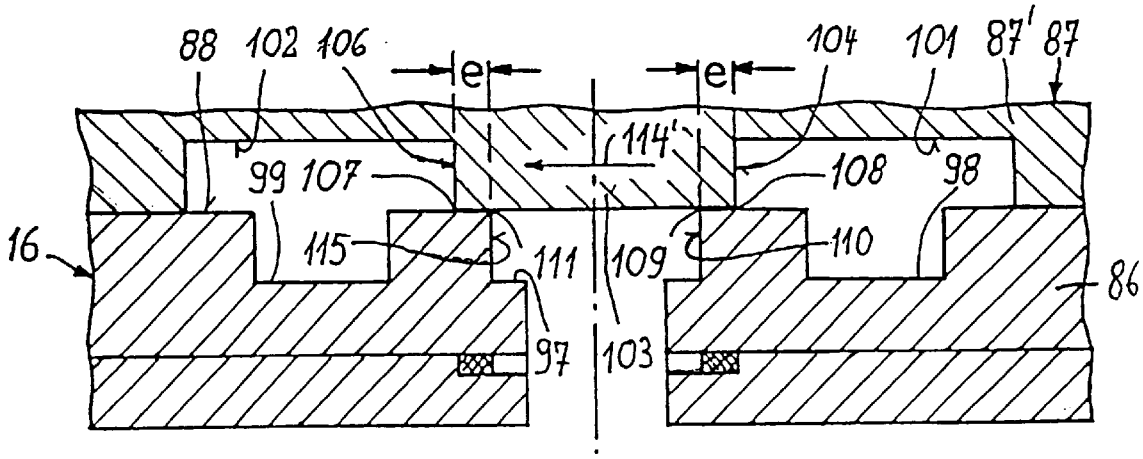
Figure 5B:
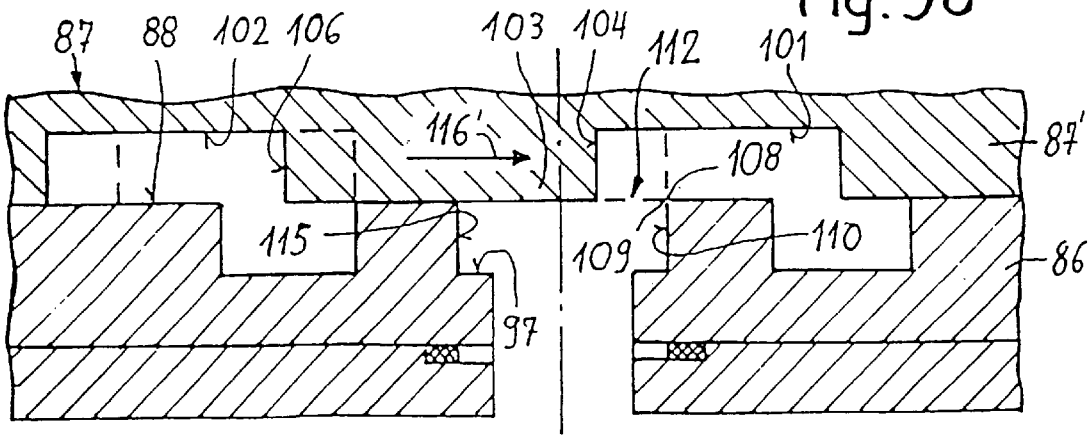

FIG. 4 shows the arrangement of the bores in the piston of the main control valve, provided to receive the pistons and actuating elements of the valves of the drive unit according to FIGS. 2 and 3, relative to the central lengthwise axis of the main control valve in a sectioning plane perpendicular to the latter along line A—A in FIG. 2; and FIGS. 5*a* and 5*b* show details of the arrangement and design of the control edges of the main control valve of the drive unit according to FIGS. 1 to 4 in a considerably enlarged sectional representation along a radial plane of the main control valve that contains the central axis of the main control valve and the central axis of the power drive.

The hydraulic drive unit indicated in FIGS. 1, 2, and 3 by 10 consists of a hydraulic motor 11 designed to deliver high driving forces and a high driving power, and an electrohydraulic control unit provided for its drive control and designated as a whole by 12, said control unit being shown in a frame 14 permanently connected in FIG. 1 with housing 13 of hydraulic motor 11, said housing forming the geometric base for providing a main control valve 16, a fine control valve 17 of a hydraulic positioning drive 18, and an overtravel regulating valve 19, of which electrohydraulic control unit 12 is composed. Drive unit 10 is intended for applications in which high driving forces and high driving powers are required, when correspondingly high hydraulic oil flows develop and must be controllable as precisely as possible. Such applications of drive unit 10 include for example drives for stamping, molding, and/or embossing tools as well as the positioning and displacement of heavy workpieces with respect to a machining station of a machining center, on which chip-removing machining of the workpiece takes place for example, with said workpiece being displaced relative to a tool mounted integrally with the machine.

Hydraulic motor 11 provided as a power drive in the embodiment shown is designed as a double-acting linear cylinder with a piston rod 21 emerging on one side from the housing.

Hydraulic cylinder 11 is connected as a differential cylinder which, upon pressurization of both drive chamber 22 of hydraulic cylinder 11 on the rod side and drive chamber 24 delimited movably and in a pressure-tight fashion from the bottom side by piston 23, executes the outward stroke under the output pressure of pressure supply assembly 26, and when only drive chamber 22 on the rod side is pressurized and the pressure is released from bottom-side drive chamber 24, performs the retraction stroke of piston rod 21.

In accordance with the differential operating mode of hydraulic cylinder 11 provided in drive unit 10, said cylinder is controlled only by the application and release of pressure in its bottom-side drive chamber 24, while drive chamber 22 on the rod side is permanently exposed to the output pressure of the pressure supply assembly.

The ratio $F_1$:$F_2$ of the piston surface $F_1$ on the bottom side, which can be exposed to pressure, to the annular piston surface $F_2$ on the rod side of drive piston 23 of hydraulic cylinder 11 in the embodiment shown, in which the same advancing forces can be deployed in both alternate movement directions of piston 23, is 2:1.

The application of pressure to, and release of pressure from, rod-side drive chamber 24 of hydraulic cylinder 11 is produced by main control valve 16 and fine control valve 17 which are connected in parallel hydraulically and are jointly operable by means of hydraulic adjusting drive 18, which in turn is designed as a double-acting linear differential cylinder, whose piston rod 28, emerging on one side from its housing 27, is rigidly connected with the movable valve elements on main control valve 16 and fine control valve 17, which thus can be displaced back and forth jointly along parallel axes 29 and 31.

In adjusting cylinder 18 as well, the ratio $f_1$:$f_2$ of area $f_1$ of its piston 32, which movably delimits bottom-side drive chamber 33 of positioning cylinder 18, to the annular surface $f_2$ of its piston 32, which forms the unilaterally movable limit of its rod-side drive chamber 34, to which the high output pressure of pressure supply assembly 26 is permanently coupled, is 2:1, so that the positioning forces that can be exerted in the two alternate movement directions of positioning cylinder piston 32 on the movable elements of main control valve 16 and fine control valve 17 are also the same, said forces being controllable by the application of pressure to, and the removal of pressure from, bottom-side control chamber 33 of positioning cylinder 18.

Overtravel regulating valve 19 provided for controlling this movement of positioning drive 18 operates with electrically controllable setting of the set position of piston 23 of power hydraulic cylinder 11, for example by pulsed control by a rotationally drivable stepping motor 36, and mechanical feedback of the actual position of drive cylinder piston 23 on the one hand and mechanical feedback of the position of piston 23 of positioning cylinder 18 on the other hand, this being accomplished by virtue of the fact that in the embodiment shown, housing 37 of overtravel regulating valve 19 is also rigidly connected movementwise with piston rod 28 of positioning cylinder 18 and thus can be displaced back and forth along another central lengthwise axis 38 of overtravel regulating valve 19 that runs parallel to central lengthwise axis 29 of positioning drive 18, along which axis 38 two valve bodies 39 and 41 are displaceable relative to valve housing 37, which the actuating device of overtravel regulating valve 19, provided for position setpoint setting as well as for position actual value feedback, and designated as a whole by 42, engages.

Actuating device 42 of overtravel regulating valve 19 comprises, in the coaxial arrangement with respect to a common central lengthwise axis 43 which also marks the rotational axis of output shaft 44 of the stepping motor provided on one housing wall 46, located on the right in the view in FIG. 1, and the rotational axis of a threaded spindle 48 mounted rotatably but axially immovably on opposite "left" housing wall 47, a hollow shaft 49 that serves as a position setpoint setting element, said shaft meshing at its stepping motor end with parallel toothing of output shaft 44 of stepping motor 36 and as a result is rotationally drivable by means of stepping motor 36. At its opposite end, hollow shaft 49 is provided with an internal thread 51 by which it is in meshing engagement with thread 52 of threaded spindle 48.

Threaded spindle 48 is drivable in alternate rotational directions by means of a toothed belt drive designated as a whole by 53, said drive being assumed to have zero play. Toothed belt 54 is self-contained and runs over a toothed roller 56 connected nonrotatably with threaded spindle 48 and over another toothed roller 57 rotatably mounted on an axis 58 that is integral with the housing and runs parallel to rotational axis 43 of threaded spindle 48, whose distance, measured in the direction of central lengthwise axis 59 of linear cylinder 11 provided as a power drive from rotational axis 43 of threaded spindle 48, is much greater than the maximum stroke which piston 23 of drive cylinder 11 can perform between its possible end positions.

Toothed belt drive 53 has a run 61 that is exactly parallel to central lengthwise axis 59 of linear cylinder 11, said run being coupled movementwise by means of a mechanically rigid connecting element 62 with piston 21 of drive cylinder 11 and subject to the same deflections as the latter. By means of this toothed belt drive 53, therefore, the axial movements of piston 21 are converted into rotational feedback movements of threaded spindle 48. The direction of rotation of the rotational position setpoint setting movements of hollow shaft 49, by means of which a certain displacement rate of pistons 21, 23 of drive cylinder 11 in a predetermined direction is to be produced and the direction of rotation of the turns of feedback spindle 48 that result from the feedback of the actual position value of drive cylinder pistons 21, 23 are selected so that when the setpoint and actual values are the same, there is no displacement of hollow shaft 49 with respect to threaded spindle 48, while both at the beginning of the assumption of a position setpoint at which an increase of the difference between the setpoint and the actual value begins, and also at the end of a change in the setpoint setting, when a reduction of the difference between the setpoint and the actual value begins, respectively opposite relative movements of hollow shaft 49 and threaded spindle 48 are linked in such manner that hollow shaft 49 undergoes axial displacements in the two alternate directions.

The overtravel regulating valve, for whose further explanation the reader is likewise referred to FIG. 2, is, in terms of its function, a 3/3-way valve which in a so-called exploded design is made of two 2/3-way valves 19', 19", whose valve bodies 39 and 41, designed as pistons and each represented in FIG. 1 by the valve symbol, are displaceably guided in a pressure-tight manner in a through bore 63 of valve housing 37.

The two valve bodies 39 and 41 of overtravel regulating valve 19 are forced apart by a centrally located spring 64 and tensioned between adjusting screws 66 and 67 that are screwably guided in the threads of actuating arms 68 and 69 that extend radially to central lengthwise axis 43 of actuating device 42, said arms each being connected by means of a ball bearing 71 or 72 in an axially nondisplaceable manner with hollow shaft 49, but are decoupled from its rotary movements. The two valve bodies 39, 41 of the two partial valves 19', 19" of overtravel regulating valve 19 are adjustable by means of adjusting screws 66, 67 in such fashion that the axial spacing of control edges 73, 74 of the valve bodies of partial valve 19', on the "right" according to the drawing in FIGS. 1 and 2, and of the "left" partial valve 19" of overtravel regulating valve 19 is equal to the axial spacing of control edges 76, 77 of valve housing 37 of overtravel regulating valve 19, by virtue of whose relative movements in alternate directions either a flow path 78 (FIG. 1) of "right" partial valve 19' is opened, by which control output 79 of overtravel regulating valve 19, said output being connected with bottom-side drive chamber 33 of positioning cylinder 18, is connected with pressure (P) output 81 of pressure supply assembly 26 or a through flow path 82 of "left" partial valve 19" of overtravel regulating valve 19 is opened, through which the (zero-pressure) tank connection 83 of pressure supply assembly 26 is connected with control connection 79 of overtravel regulating valve 19, which is kept by control path 84 in permanently communicating connection with bottom-side drive chamber 33 of hydraulic positioning drive 18. An absolute blocking position II of the respective other partial valve 19" or 19' corresponds to these through flow positions I of the two partial valves 19', 19" of overtravel regulating valve 19, so that these two partial valves 19', 19", after their valve bodies have been set so that the distances of their control edges 73, 74 equal the distance between control edges 76, 77 of common valve housing 37, perform the function of a 3/3-way valve that from its basic position 0 that corresponds to a value 0 of the overlap of control edges 73 and 74 of valve bodies 39, 41 with control edges 76, 77 of valve housing 37, whereby in this basic position 0 both high-pressure output 81 of pressure supply assembly 26 and its tank connection 83 are cut off from control connection 79 of overtravel regulating valve 19 by a displacement of the two valve bodies 39, 41 relative to housing 37 of overtravel regulating valve 19 rightward is bringable by displacement of both valve bodies 39, 41 rightward relative to housing 37 of overtravel regulating valve 19 into a functional position in which bottom-side drive chamber 33 of positioning cylinder 18 is exposed to the high output pressure of pressure supply assembly 26 and is cut off from zero-pressure tank connection 83 of pressure supply assembly 26 and, by a leftward displacement relative to valve housing 37 is bringable into a functional position in which bottom-side drive chamber 33 of positioning cylinder 18 is connected with zero-pressure tank connection 83 of pressure supply assembly 26 and is cut off from high-pressure output 81 of pressure supply assembly 26.

The main control valve 16 in the embodiment selected for explanation, in which power drive cylinder 11 is operated as a differential cylinder whose rod-side drive chamber 22 is permanently exposed to the output pressure of pressure supply assembly 26, is designed as a 3/3-way slide valve whose housing 86 is permanently connected with housing 13 of drive cylinder 11. Piston 87 of main control valve 16, represented in FIG. 1 by the 3/3-way valve symbol and shown in FIG. 2 as well as FIG. 3, whose details will likewise be provided later, in a technically feasible configuration of main control valve 16 as well as overtravel regulating valve 19 (FIG. 2) and fine control valve 17 (FIG. 3), is guided displaceably and pressure-tight in a housing bore 88 in which P-connecting channel 89 for the pressure medium supply from pressure supply assembly 26 and T-connecting channel 91, to which feedback line 93 that leads to supply container 92 of pressure supply assembly 26 is connected, terminate radially. Control output 94 of main control valve 16 is formed by a radial housing channel that connects directly with connecting channel 96 that is flush therewith, through which hydraulic oil can flow into bottom-side drive chamber 24 of the drive cylinder and can flow out of it again.

Control channel 96 of housing 86 of main control valve 16 begins at an inner annular groove 97 of valve housing 86 which is between an annular groove 98 of housing 86 which permanently communicates with P-connection 83 and an annular groove 99 of valve housing 86 which is in a permanent communicating relationship with T-connecting channel 91.

Piston 87 of main control valve 16 is provided with a first external annular groove 101 which, within the possible displacement range of valve piston 87, remains constantly in communicating connection with P-groove 98 of valve housing 86 and is bringable by displacement of valve body 87 as shown in FIG. 2 to the left in an overlap with the cross-sectional area of central annular groove 97 of housing 86 of main control valve for coupling pressure into bottom-side drive chamber 24 of drive cylinder 11, with the main control valve reaching functional position I in which T-groove 99 is simultaneously cut off from control connecting channel 94 of main control valve 16. In addition, piston 87 is provided with a second external annular groove 102 which, within the possible displacement range of valve piston 87, always remains in communicating connection with T-groove 99 of valve housing 86 of the main control valve and, by axial displacement of valve piston 87 to the right as shown in FIG. 2, is likewise bringable into a cross-sectional overlap with central annular groove 97 of valve housing 86, so that hydraulic oil can flow from bottom-side drive chamber 24 of drive cylinder 11 into supply container 92 of pressure supply assembly 26. In this functional position II of main control valve 16, T-groove 94 is cut off from control channel 94 of main control valve 16.

In the intermediate position of valve piston 87, used as basic position 0, between its functional positions I and II, both P-connecting channel 89 and T-connecting channel 91 of main control valve 16 are cut off from its control output 94, with annular groove 97 of valve housing 86 being completely closed in this basic position 0 by annular rib 103 that remains between the two outer grooves 101, 102 of valve piston 87 and piston-side control edges 107 and 108 formed by its radial cheeks 104 and 106 with housing-side control edges 109 and 111 (FIGS. 3, 5*a*, and 5*b*), formed by the circular transitional edges, by which radial groove cheeks 110 and 115 of central housing groove 97 abut central bore 88 of valve housing 86, are in a positive, and in terms of amount, approximately equal overlap e.

"Positive overlap" here means that valve piston 87, starting at basic position 0 of main control valve 16, must first be displaced by an amount e of overlap in the axial direction before the through flow path 112 or 113 to be opened up in the respective functional position I or II begins to open, depending on the displacement direction, and creates an increasing overflow cross section with increasing displacement.

Before explaining additional structural and functional details of drive unit 10 in the following, mention should first be made of the function of the functional elements of drive unit 10 mentioned thus far:

If piston 23 of drive cylinder 11, starting from a starting position which can be assumed to be known, for example the end position shown in FIG. 3 and corresponding to the completely retracted state of piston 23, is supposed to execute an extension stroke h of a defined amount, bottom-side control chamber 24 of drive cylinder 11 must be pressurized, in other words main control valve 16 must be brought into its functional position I shown in FIG. 2 until the set position corresponding to the performance of stroke h has been reached and, upon this position being reached, can again return to its basic position as shown in FIG. 3. In order to bring main control valve 16 into this functional position, according to the drawings in FIGS. 1 to 3, a leftward displacement of valve piston 87 is required, in other words a release of the pressure in bottom-side drive chamber 33 of positioning cylinder 18 which in turn requires an (initiating) leftward displacement of pistons 39 and 41 of overtravel regulating valve 19, so that partial valve 19" of overtravel regulating valve 19 opens through flow path 82 to connect bottom-side drive chamber 33 of positioning cylinder 18 with the zero-pressure supply contained in 92 of the pressure supply assembly. In the design of threaded spindle 48 shown, assuming a right-hand thread, the required displacement of valve pistons 39 and 41 of overtravel regulating valve 19 is achieved by virtue of the fact that stepping motor 36, viewed in the direction of arrow 114 in FIG. 2, is controlled to rotate clockwise, in which direction hollow shaft 49 also turns and as a result,because of its threaded engagement with threaded spindle 48, undergoes a leftward movement, followed by valve pistons 39 and 41 of overtravel regulating valve 19. As a result of the resultant opening of flow path 82 of overtravel regulating valve 19, through which hydraulic oil can then flow from bottom-side drive chamber 33 of positioning cylinder 18, its piston 32 undergoes a leftward displacement, followed by piston 87 of main control valve 16, which thus reaches its functional position I. This displacement is also performed by housing 37 of overtravel regulating valve, so that the latter is again brought back again, so to speak, into the basic position 0 of its partial valves 19' and 19", with the result that the flow of hydraulic oil out of bottom-side drive chamber 33 of positioning cylinder 18 is again interrupted, so that piston 32 of positioning cylinder 18 remains linked with a certain opening cross section of opened flow path 112 of the main control valve, and with it housing 37 of overtravel regulating valve 19. When the outward movement of piston 23 of drive cylinder 11 begins, by means of toothed belt drive 53, threaded spindle 48, as viewed in the direction of arrow 116 in FIGS. 1 to 3, is also driven rotationally counterclockwise. As a result, hollow shaft 49, moved in the initial phase of set value control, is now forced rightward, so that pistons 39 and 41 of overtravel regulating valve 19 are also displaced rightward relative to its housing 37, with the result that through flow path 78 of partial valve 19' of overtravel regulating valve 19 is opened and as a result hydraulic oil can again be forced into bottom-side drive chamber 33 of positioning cylinder 18. Positioning cylinder 18 is thus driven to reduce the previously exposed cross section of through flow path 112 of main control valve 16, with the afflux of hydraulic oil into bottom-side drive chamber 24 of drive cylinder 11 first being reduced, so that its extension speed decreases, while on the other hand housing 37 of the overtravel regulating valve is again pushed in the direction, rightward, in which through flow path 78 of partial valve 19' of overtravel regulating valve 19 is blocked once more and the afflux of hydraulic oil into bottom-side drive chamber 33 of positioning cylinder 18 is interrupted. Piston 32 of positioning cylinder 18 then remains in a position that corresponds to a reduced throughflow cross section of the still-open flow path 112 of main control valve 16, with which the lower speed of movement v of drive piston 23 of hydraulic cylinder 11 is linked.

As a result, threaded spindle 48 is driven by toothed belt drive 53 at a lower rotational speed, so that a setpoint control corresponding to a constant movement speed v of drive piston 23 of drive cylinder 11 is assumed by stepping motor 36 with a constant rate of change of the position setpoint, finally after several regulating cycles of the type described a "steady state" equilibrium results in which hollow shaft 49 and threaded spindle 48, which is in meshing engagement with its thread 51, rotate at the same angular speed, with the result that pistons 39 and 41 of the two partial valves 19' and 19" of overtravel regulating valve 19 stick in the positions that correspond to the basic positions 0 of these partial valves 19' and 19" or perform only slight alternating deflections with respect to these positions, and through flow path 112 opened up in basic position I of the main control valve is set to an opening cross section at which, under the prevailing operating pressure, a volume of hydraulic oil can flow into bottom-side drive chamber 24 of drive cylinder 11, and is forced out of its rod-side drive chamber 22, that corresponds to the desired setpoint of this speed.

With the above type of stepping motor-controlled position and speed setpoint setting, the total stroke which piston 23 of drive cylinder 11 is to perform, encoded into the number of electrical control pulses by which stepping motor 36 must be controlled until complete execution of the piston stroke, the speed with which the piston performs this stroke is encoded into the frequency of the control pulses, and the rotational direction in which the stepping motor rotates, are controlled for example by the polarity of the control pulses of said motor or the phase position of two or more control pulse trains with one another, with the exciter windings of the stepping motor, which in a typical design for performing a 360° revolution of its drive shaft 44 is controlled in 400 stepping pulses each of which results in a rotation of drive shaft 44 by 0.9°.

Hydraulic drive unit 10, comprehensively described thus far in terms of its design and function, includes two regulating circuits coupled with one another by overtravel regulating valve 19, one of which circuits being designed as an overtravel regulating circuit for positioning drive 18 and the second being designed as an overtravel regulating circuit for drive cylinder 11.

The regulating circuit that acts on drive cylinder 11 has a regulating circuit amplification $K_v$ expressed by the relationship $$K_v = v/s \tag{1}$$

where v represents the (constant) speed of movement of drive piston 23 in the steady-state (stationary) condition of regulation and s is an overtravel distance that represents the "distance" (difference) between for example the setpoint of the position of piston 23 controlled by means of stepping motor 36 and its actual value A typical value for the circuit amplification $K_v$ of the power regulating circuit for example is 10 $s^{-1}$.

For reasons of good stability of regulation, the circuit amplification corresponding to relationship (1), taking into account a damping that is always present, should not be greater than the eigenfrequency $f_0$ to be assumed for the fictional damping-free case, said frequency being given by the relationship $$f_0 = \frac{1}{2\pi} \cdot \sqrt{\frac{c}{m}} \tag{2}$$

in which c represents the hydraulic rigidity which is determined primarily by the rigidity of the enclosed oil columns, while m refers to the mass driven by the drive circuit, for example the ram of a press. On the other hand, it follows from relationship (2) that the circuit amplification of positioning drive 18, whose pressurization and depressurization are controlled by overtravel regulating valve 19, can be very high, since the hydraulic rigidity of this regulating circuit is high because of the limited length of the enclosed oil columns and the mass to be moved, primarily the mass of piston 87 of main control valve 16, is small. Compared with the main drive regulating circuit, for which a circuit amplification $K_{v1}$ of 10 $s^{-1}$ could be a typical value, the overtravel regulating circuit of the positioning drive can be operated with a circuit amplification $K_{v2}$, which can be higher by a factor of 50 to 100 than those of the drive regulating circuit.

As a result it is possible, with a small input power on the setpoint side (essentially the electrical driving power of the setpoint setting motor 36), to control high hydraulic useful powers.

To explain fine control valve 17 shown schematically in FIG. 1 and shown in FIG. 3 with its structural details, reference will now be made once more to the cross-sectional representation in FIG. 4, which shows the arrangement of through bore 63 of overtravel regulating valve 19, a through valve bore 117 of fine control valve 17, and two chamber bores 118 of hydraulic positioning drive 18 within piston 87 of main control valve 16, which in turn is received by through bore 88 of housing 86 of main control valve 16.

The central lengthwise axis 38 of bore 63, the central lengthwise axes 119 of the two bores 118 for positioning drive 18, and central lengthwise axis 121 of through bore 117 of piston 87 that forms the housing for overtravel regulating valve 19 and fine control valve 17 of main control valve 16 lie on a concentric hole circle, receiving with central lengthwise axis 43 a lengthwise bore 122 that receives hollow shaft 49 of actuating device 42 of the overtravel regulating valve, said bore 122 having the same diameter apart from a small amount of play, and are arranged along the latter at equal azimuthal distances from 90°, with bores 63 and 117 for overtravel regulating valve 19 and fine control valve 17 being located diametrally opposite one another with respect to central lengthwise axis 43 of central bore 122 that receives hollow shaft 49, and similarly bores 118 for positioning drive 18.

The purpose of fine control valve 17 connected hydraulically in parallel with main control valve 16 is to permit a high positioning accuracy of power drive hydraulic motor 11 even when control edges 107 and 108 of piston 87 on the piston side and control edges 109 and 111 of main control valve 16 on the housing side, as seen in their basic positions, have a relatively large positive overlap e, as explained with reference to FIGS. 2 and 3 above and shown on an enlarged scale in FIG. 5*a,* to which reference is also made.

If, beginning at this basic position 0 of main control valve 16 whose piston 87 is displaced as a consequence of its control by overtravel regulating valve 19 in the direction of arrow 114', i.e. leftward in FIG. 5*a,* an increasing opening of flow path 112 of main control valve 116 begins only when its piston 87 has reached the position indicated by the dashed lines in FIG. 5*b,* to which reference is also made, i.e. its one (right-hand) piston-side control edge 108 and the right-hand control edge 109 on the housing side are arranged opposite one another with zero overlap. It is only upon further displacement of valve piston 87 of main control valve 16, with increasing opening cross section, that flow path 112 of the main control valve, i.e. its functional position I, is opened. An outward movement of piston 23 of power drive hydraulic motor 11, linked with this, therefore in practice begins only at the moment when the overlap of these two control edges 108 and 109 begins to become negative.

If the control of stepping motor 16 is terminated by position setpoint setting pulses after a constant advance rate of piston 23 of power hydraulic motor 11 has been established in the meanwhile by the overtravel regulation explained above, which corresponds to the position of valve piston 87 of main control valve 16 relative to its housing 86 as shown in solid lines in FIG. 5*b,* a displacement of piston 87 of main control valve 16 results relative to its valve housing 86, directed in the direction of arrow 116', and therefore leads to a blockage of flow path 112 that is opened in functional position I of main control valve 116 when piston-side control edge 108 and housing-side control edge 109 have again reached the position that corresponds to a zero overlap and is drawn dashed in FIG. 5*b,* with the consequence that after this position is reached by a movement of piston 87 in the direction of arrow 116, drive piston 23 of power hydraulic motor 11 stops, i.e. before main control valve 16 again reaches its basic position 0 shown in FIG. 5*a.*

The resultant hysteresis of main control valve 16 caused by this with respect to functional positions 0 and I and 0 and II of partial valves 19' and 19" of overtravel regulating valve 19 would, in view of the end positions of drive piston 23 of power hydraulic motor 11, result in an inaccuracy that would increase directly with the positive overlap of piston-side control edges 107 and 108 with housing-side control edges 111 and 109 in the basic position of main control valve 16.

In order to avoid such an inaccuracy in the positions that can be reached by piston 23 of power hydraulic motor 11, fine control valve 17 is also designed so that it opens up a through flow path 112' functionally corresponding to throughflow path 112 of main control valve 116, through which the output pressure of pressure supply assembly 26 can be coupled into bottom-side drive chamber 24 of power hydraulic motor 11, or a through flow path 113 functionally corresponding to through flow path 113 of main control valve 16, when main control valve 16 is caused to assume its functional position I or its functional position II.

This means that control edges 124 and 126 on the valve body side and control edges 127 and 128 on the housing side of fine control valve 17, through whose relative movements either the one through flow path 112' or the other through flow path 113' of fine control valve 17 can be opened with a variable flow cross section, in the basic position of fine control valve 17 must have an overlap of 0 or must have an overlap that is positive and slightly different from 0 in any case, and that the basic positions 0 of both fine control valve 17 and main control valve 16 must match exactly, i.e. to the greatest extent possible.

For this purpose, fine control valve 17, by analogy with overlap regulating valve 19, is designed to consist of two partial valves 17' and 17", each of which has a piston 129 or 131 that is cylindrical in terms of its basic form, said pistons being received by through bore 117 of the "housing" of fine control valve 17 formed by piston 87 of main control valve 16.

These pistons 129 and 131 each have an annular groove 132 or 133, whose radial groove cheeks remote from one another abut the cylindrical jacket surfaces by control edges 124 and 126 on the piston side, said jacket surfaces being received in a pressure-tight and slidable fashion by through bore 117 of the piston part of main control valve piston 87 that forms the housing of the fine control valve.

Pistons 129 and 131 of the two fine control valve elements 17' and 17" are urged by a pretensioned centrally disposed spring 134, each against a stop pin 136 or 137, arranged coaxially with respect to central lengthwise axis 121 of through bore 117 of piston 87 of the main control valve that forms the housing of fine control valve 17. These stop pins 131 and 137 are designed as adjusting screws, screwably guided in the threaded bores of housing 86 of the main control valve, by means of which screws the positions of piston-side control edges 124 and 126 of pistons 129 and 131 of the fine control valve can be adjusted relative to housing 86 of main control valve 16. As a result, it is possible to adjust the distance, measured along central axis 121 of through bore 117 of piston 87 of main control valve 16, of control edges 124 and 126 of valve bodies 129 and 131 of partial valves 17' and 17" of fine control valve 17 exactly to the design distance between their housing-side control edges 127 and 128 provided on movable piston 87 of main control valve 16.

Therefore, fine control valve 17, with piston 87 of main control valve 16 at rest, can always be adjusted in such fashion that the overlap of its piston-side control edges 124 and 126 with its housing-side control edges 127 and 128 is zero or corresponds to any desired (small) value when fine control valve 17 is in its basic position.

Merely by virtue of this alone, it is possible to determine experimentally, i.e. by tests, a position of piston elements 129 and 131 of fine control valve 17 that corresponds to a basic position 0 of main control valve 16 in which control edges 107 and 108 of its valve piston 87 have the same (positive) overlap of the same amount with control edges 109 and 111 on the housing side and critical for the main control valve, and as a result to adjust fine control valve 17 to the said position of its valve piston elements 129 and 131.

By virtue of this adjustability of pistons 129 and 131 of partial valves 17' and 17" that form fine control valve 17, which, depending on their functions, are commonly controlled 2/3-way valves with a basic position 0 that corresponds to zero overlap or a very small (positive) overlap of their control edges 124 and 127 or 126 and 128, a through flow position I, and a blocked position II, with one partial valve 17' or 17" entering its blocking position II when the other partial valve 17" or 17' reaches its through flow position I, with each deflection of valve piston 87 of main control valve 16 and the displacement, which begins at this point, of the housing of fine control valve 17 formed by this piston 87, there is a definite change in the effective through flow cross section, so that hydraulic oil can be forced into bottom-side drive chamber 24 of driving hydraulic motor 11 or can flow out of the latter, and that when this flow path is blocked, i.e. in the stopping position of piston 23 of driving hydraulic motor 11, a precisely defined position of piston 87 of main control valve 16 and of the housing of fine control valve 17 is always linked, which is presettable by the housing-integral arrangement of its valve pistons 129 and 131. Therefore, with hydraulic drive unit 10, a very accurate and sensitive maintenance of a predetermined position of piston 23 of hydraulic motor 11 is possible only with low control energy that can be controlled by means of stepping motor 36 and overtravel regulating valve 19, as already explained in detail.

Piston 87, mounted displaceably to reciprocate in housing 86, is made in two parts for manufacturing reasons and comprises an outer piston part 87' that has a thick wall and is in the form of a jacket, provided with P- and T-grooves 101 and 102 on the piston side, and an inner piston part 87" in the form of a cylindrical block, provided with central through bore 122 traversed by hollow shaft 49 of actuating device 42 of overtravel regulating valve 19, through bore 63 of overtravel regulating valve 19, through bore 117 of fine control valve 17, and chamber bores 118 for positioning drive 18.

The chamber bores designated in FIGS. 2, 3, and 4 by 118 in each case are designed as blind holes which, according to the drawings in FIGS. 2 and 3, are made from the right side of inner piston part 87" into the latter. A cylindrical piston 138 is mounted movably and in a pressure-tight fashion relative to piston element 87" of main control valve piston 87, which is supported axially on a slender stop pin 139 that extends along central lengthwise axis 119 of the respective bore 118 and is integral with the housing.

The chambers delimited by the two blind holes 118 and the two pistons 138, said chambers being in communicating connection with outer P-groove 101 by radial channels of inner piston element 87" and outer piston element 87', together form drive chamber 34 of positioning drive 18 which is permanently exposed to output pressure P of the pressure supply assembly during operation of the drive unit, shown in FIG. 1 as the rod-side chamber of double-acting positioning drive cylinder 18.

In a coaxial arrangement with central lengthwise axis 119 of blind holes 138, blind holes 118' are made in inner piston part 87' of piston 87 of main control valve 16, also from the left end, in each of which holes a cylindrical piston 138' is placed displaceably in a pressure-tight manner relative to piston element 87", which in turn is axially supported on a stop pin 139' extending along central lengthwise axis 121 of respective bore 118'.

These two blind holes 118' and the two pistons 138' whose cross-sectional areas are each larger by a factor of 2 than those of the chambers delimited by blind holes 118 and pistons 138 located axially opposite, said chambers being alternately connectable by overtravel regulating valve 19 with zero-pressure supply container 92 of the pressure supply assembly or its high-pressure output 81, together form the drive chamber shown in FIG. 1 as bottom-side drive chamber 33 of positioning drive 18.

By the above-described integration of overtravel regulating valve 19, fine control valve 17, and positioning drive 18 formed as a whole by two piston and bore pairs in piston 87 of the main control valve, an especially compact design of the electrohydraulic control part of drive unit 10 is achieved which because of the short lengths of the hydraulic oil flow paths also results in a high hydraulic rigidity and therefore contributes to high values for the circuit amplification $K_v$ that can be reached.

Drive unit 10 is equipped with an electronic position sensor 141 that is only shown schematically, whose output signal is an exact measure for deflections of actuating device 42 of overtravel regulating valve 19 in the direction of central lengthwise axis 43 of actuating device 42.

In a special design, position sensor 141 is in the form of a magnetic field sensor mounted permanently on housing 86 of main control valve 16, said sensor detecting the field strength of a permanently mounted permanent magnet 142 on one of actuating arms 68 or 69 of overtravel regulating valve 19, said magnet being so arranged that the field strength at the location of the magnetic field sensor varies linearly in a very good approximation with the axial movements of actuating device 42, so that the output signal of magnetic field sensor 141 is directly proportional to the deflection stroke of actuating device 42, for example of its hollow shaft 49.

Position sensor 141 can be simply calibrated by recording its travel/output signal level characteristic and approaching the basic positions of overtravel regulating valve 19 and of fine control valve 17 and/or of main control valve 16, and can be used for a continuous determination of overtravel distance s.

Alternatively or in addition to position sensor 141 that detects the position of hollow shaft 49 of actuating device 42, a position sensor, not shown, can also be provided which detects the deflections of valve piston 87 of main control valve 16 relative to its housing 86.

In FIGS. 1 to 5*b*, elements whose design or functions are the same or analogous have all been given the same reference numerals. To the extent that reference numerals are provided for elements in FIGS. 1–5*b* that are not mentioned in the explanation of the respective figures, but have been described with reference to another figure, reference is made to the applicable portion of the specification.

I claim:

1. Hydraulic drive unit with (a) a hydraulic motor;

(b) a main control valve which controls fluid flow to and from said hydraulic motor;

(c) a hydraulic servo drive, including double-acting linear cylinder, for actuating said main control valve;

(d) an overtravel regulating valve which controls said servo drive, and includes a blocking position and alternative through flow positions associated with alternate driving directions of said hydraulic motor, said overtravel regulating valve being controlled by a comparison of a setpoint and an actual position, wherein the setpoint is controlled by an electric motor, and said actual position is generated by mechanical feedback from said hydraulic motor;

(e) the overtravel regulating valve and the main control valve being piston slide valves operable by relative axial displacements of associated valve pistons and associated housing elements that occur along mutually parallel axes, and said valve piston of the main control valve forms the housing element of the overtravel regulating valve;

(f) wherein said overtravel regulating valve (19) has two piston elements (39, 41) extending in a through bore (63) in said valve piston (67) of said main control valve that is parallel to and radially displaced from a central lengthwise axis (43) of said valve piston of said main control valve, with an axial spacing of said Piston elements (39, 41) being adjustable for adjustment of a defined overlap of piston-side control edges (73, 74) and housing-side control edges (76, 77) located inside said through bore (63);

(g) said valve piston (87) of said main control valve (16) is provided with a central axial through bore (122) through which passes a setpoint setting element (49) nonrotatably coupled with a drive shaft (44) of motor (36), said setpoint setting element being axially displaceable with respect to said drive shaft and said valve piston (87) of said main control valve, said setpoint setting element (49) being in zero-play threaded engagement with an actual position feedback element (48) rotationally drivable by a movable part (23) of said hydraulic motor (11);

(h) and wherein driving pressure chambers (33, 34) of said servo drive (18), being provided to actuate said main control valve (16), are formed by blind holes (118, 118') in said valve piston (87) of said main control valve (16), said blind holes being parallel to and arranged at a radial distance from the central axial through bore (122), wherein there are pistons (138, 138') received in said blind holes and supported in a fixed position with respect to said housing (86) of said main control valve (16).

2. Drive unit according to claim 1 characterized in that a fine control valve (17) is hydraulically connected in parallel with said main control valve (16), said fine control valve being a piston slide valve, with through flow paths being adjusted by relative movement of housing-side and piston-side control edges (124, 126 and 127).

3. Drive unit according to claim 2 characterized in that said fine control valve (17) comprises two piston elements (129 and 131) displaceably mounted in an axial through bore (117) of said valve piston (87) of said main control valve (16), said piston elements of said fine control valve being adjustable with respect to said housing (86) of said main control valve (16).

4. Drive unit according to claim 3 characterized in that, a pretensioned spring (134) is provided between the two piston elements (129 and 131) of said fine control valve (17), said spring urging each of said piston elements (129, 131) against an axial stop pin (136, 137) whose position is axially adjustable.

5. Drive unit according to claim 3 characterized in that each of the two piston elements (129 and 131) and a corresponding section of said axial through bore (117) of said fine control valve (17), form a 2/3-way valve (17' and 17"), one of which assumes its blocking position when the other assumes its through flow position.

6. Drive unit according to claim 3 characterized in that said axial through bore (117) of said fine control valve (17) and said through bore (63) of said overtravel regulating valve (19) are arranged diametrally opposite relative to said central lengthwise axis (43).

7. Drive unit according to claim 1 characterized in that a position sensor (141, 142) is provided that generates an output signal that corresponds to a position of an actuating element (49, 68, 69) of said overtravel regulating valve (19) said signal varying in a monotonic relationship with the position of the actuating member, and/or a position sensor which generates an electrical output signal that corresponds to a position of said valve piston (87) of said main control valve (16).

8. Drive unit according to claim 1 characterized in that said valve piston (87) of said main control valve (16) is axially displaceable by selectively connecting at least one of said driving pressure chambers of said servo drive to either a high pressure line or a low pressure line.

9. Drive unit according to claim 8 characterized in that said blind holes are a pair of two blind holes (118, 118') made in two mutually opposite faces of said piston (87) of said main control valve, and each of said pistons (138 and 138') received in each of said blind holes are axially supported on a stop pin (139 or 139') permanently mounted on said housing (86) of said main control valve (16).

10. Drive unit according to claim 9 characterized in that each piston received in each of said blind holes is a free piston.

11. Drive unit according to claim 9 characterized in that two sets of pairs of blind holes are provided wherein said blind holes of each pair are coaxial.

12. Drive unit according to claim 11 characterized in that each pair of said blind holes has an associated blind hole axis, wherein said two blind hole axes (119, 119') are arranged diametrally opposite one another with respect to said central lengthwise axis (43).

13. Drive unit according to claim 7 characterized in that said hydraulic servo drive (18) is a differential cylinder, wherein said driving pressure chambers (33 and 34) have different effective cross-sectional areas, and wherein the driving pressure chamber (34), with the smaller effective cross-sectional area is permanently connected to said high pressure supply line.

14. Drive unit according to claim 13 characterized in that a ratio of the effective cross-sectional areas of said larger driving pressure chamber to said smaller driving pressure chamber is equal to 2.

15. Drive unit according to claim 1 characterized in that said valve piston (87) of said main control valve (16) is made in two parts, with an outer sleeve-shaped piston part (87') including external annular grooves (102 and 101) forming control edges (107 and 108), and with a circularly cylindrical core (87") fitted firmly into said sleeve-shaped piston part (87') and including said through bore for said overtravel regulating valve (19), the blind holes for said driving pressure chambers (33 and 34) and said central axial through bore (122).

16. Drive unit according to claim 1 characterized in that an electronic or electromechanical position sensor (141, 142) is provided, said sensor generating an electrical output signal that corresponds to at least a position of said main control valve (16).

17. Drive unit according to claim 16 characterized in that the position sensor is a fixed magnetic field sensor (141), which detects a change in magnetic field that results from movement of a permanent magnet (142) permanently connected with a position-monitoring element.

* * * * *